US005477846A

United States Patent [19]

Cameron

[11] Patent Number: 5,477,846

[45] Date of Patent: Dec. 26, 1995

[54] FURNACE-HEAT EXCHANGER PREHEATING SYSTEM

[76] Inventor: Gordon M. Cameron, 4 Wellesbourne Cres., Willowdale, Ontario, Canada, M2H 1Y7

[21] Appl. No.: 291,818

[22] Filed: Aug. 17, 1994

[51] Int. Cl.[6] ..... F24H 3/08

[52] U.S. Cl. ..... 126/109; 126/99 C; 126/116 R; 165/139

[58] Field of Search ..... 126/110 R, 99 R, 126/116 R, 109, 99 A, 99 D, 99 C; 165/139, 159

[56] References Cited

U.S. PATENT DOCUMENTS

| | | | |
|---|---|---|---|
| 1,814,011 | 7/1931 | Snow | 126/109 |
| 2,817,498 | 12/1957 | Miller | 165/139 |
| 2,869,830 | 1/1959 | Cox | 165/139 |
| 2,917,285 | 12/1959 | Schack | 165/139 |
| 3,859,735 | 1/1975 | Katterjohn, Jr. | 165/139 |

*Primary Examiner*—James C. Yeung
*Attorney, Agent, or Firm*—Cushman Darby & Cushman

[57] ABSTRACT

The invention provides in one broad aspect an improved process fluid preheater system for raising the temperature of a process fluid with a hot furnace gas, having a combustion furnace in communication with a shell and tube heat exchanger, wherein the furnace operably produce the hot furnace gas and comprises air inlet means, fossil fuel combustion means and hot furnace gas exit means; and the heat exchanger comprises an exchanger shell, a first end radial tube sheet and a second end radial tube sheet, which define a shell space; a plurality of longitudinal tubes retained by the first and second end tube sheets within the shell and comprising heat exchange means; hot furnace gas inlet means; cooled furnace gas outlet means; process gas inlet means; and heated process fluid outlet means; the improvement comprising the plurality of tubes further comprises the hot furnace gas inlet means and the cooled furnace gas outlet means; the hot furnace gas exit means in communication with the plurality of tubes furnace gas inlet means to operably provide the tubes with the hot furnace gas. The process fluid inlet means comprises a first process fluid inlet adjacent the first tube sheet and in communication with the shell space, and a second process fluid inlet adjacent the second tube sheet and in communication with the shell space; and the heated process fluid outlet means comprises a fluid outlet essentially midway between the first and the second tube sheets and in communication with the shell space.

13 Claims, 6 Drawing Sheets

FURNACE-HEAT EXCHANGER PREHEATING SYSTEM

FIELD OF THE INVENTION

This invention relates to a preheater system comprising a combustion furnace and a heat exchanger and process for preheating fluids, particularly gases such as air and sulfur dioxide of use in the manufacture of sulfuric acid.

BACKGROUND OF THE INVENTION

Combined combustion furnaces and heat exchangers, commonly known as process preheaters are used in many industrial applications to heat process fluids, particularly process gases such as air and sulfur dioxide used in the manufacture of sulfuric acid. The preheaters may be used intermittently or continuously. Conventional preheater systems have included horizontally or vertically aligned furnaces which bum fossil fuels such as natural gas or various grades of fuel oils. The heat exchangers have included vertically or horizontally aligned exchangers wherein heat transfer to the process fluid from the furnace gas occurs. Typically, the flow of the furnace gas is countercurrent to the flow of the process gas to enhance transfer of energy and, thus, improve efficiency.

In the manufacture of sulfuric acid, older preheater systems generally comprised a furnace and an associated heat exchanger wherein the furnace was formed of a brick-lined cylindrical shell having an air blower wherein the heated furnace gas exited from the end remote from the air intake and blower. Such fossil fuel combustion furnaces produced a flame extending as much as 3–4 metres in the furnace and only modest efforts were expended to efficiently mix fuel and air. Such furnaces generally required significant periods of time to heat the brick lining to operating temperatures, which brick preheating time affected the operation of the downstream plant.

Such heat exchangers were initially formed of carbon steel, which limited the temperatures that could be generated in the furnace to less than 650° C. Further, these exchangers generally had their heat exchanger tubes vertically aligned and received furnace gas therethrough, while the shell space received the process gas to be heated. These carbon steel exchangers were susceptible to high temperature scaling and, thus, needed to be frequently replaced. In addition, in consequence of the very high temperatures produced in the furnace, it was necessary for large quantities of excess air and/or, larger exchangers to be used. High temperature combustion further increased the risks of formation of unwanted nitrogen oxides and smoke in the preheater exit gas.

Later preheater exchangers were formed of stainless steel and were, thus, able to operate at higher temperatures to provide higher thermal efficiencies. In the sulfuric acid industry, the preheater systems generally had long, horizontal, cylindrical furnaces with either a vertical exchanger or a horizontal exchanger mounted on top of the horizontal furnace. These newer designs also permitted rapid firing in the furnace, incorporated flue gas recycle and air preheating where required to improve thermal efficiency and to minimize formation of nitrogen oxides.

Preheater systems presently in use suffer from a number of disadvantages. It has been found that the shape of the combustion flame of the furnace may be variable in operation and cause inefficient radiative transfer of heat to the heat exchanger. Relatively low intensity combustion results in a longer residence time of the reactants in the furnace which favours the formation of unwanted nitrogen oxides. Further, high temperatures of the metal at the hot end of an exchanger may cause high temperature damage by scale formation and uneven thermal stresses. Yet further, most preheaters of the prior art do not allow of easy adaptation to higher energy efficiency by such optional features such as stack gas recycle and air preheating with stack gas. Horizontal, cylindrical furnaces occupy significant space on industrial sites where space is at an economic cost premium.

Accordingly, there is a need for an improved preheater system which does not suffer from the foresaid disadvantages of prior art preheaters.

SUMMARY OF THE INVENTION

It is an object of tile present invention to provide a preheater which occupies a relatively small space within the overall manufacturing plant.

It is a further object of the present invention is to provide a preheater of reduced conventional diameter and size and resultant economic cost.

It is a yet further object to provide a preheater system which is operative at relatively high furnace temperatures, reduced furnace gas flow and is of reduced conventional furnace size and exchange area.

A still yet further object is to provide an improved preheater having smaller than conventional shell diameters in consequence of reduced flow resistance of the gas in the shell and reduced pressure losses.

It is a further object to provide an improved preheater having improved controllability of metal temperatures in the heat exchanger.

A further object is to provide an improved preheater more readily adaptable to receive a secondary air/stack gas exchanger and provide improved efficiency and desired stack dimensions.

These and other objects of the invention will be readily seen from a reading of the specification as a whole.

Accordingly, the invention provides in one broad aspect an improved process fluid preheater system for raising the temperature of a process fluid by heat transfer with a hot furnace gas, said system having a combustion furnace in communication with a shell and tube heat exchanger, wherein said furnace operably produces said hot furnace gas and comprises air inlet means, fossil fuel inlet means, a combustion chamber and hot furnace gas exit means; and said heat exchanger comprises an exchanger shell, a first end tube sheet and a second end tube sheet, which said shell and said tube sheets define a shell space;

a tube bundle comprising a plurality of longitudinal tubes retained by said first and second end tube sheets within said shell space and comprise heat exchange means;

hot furnace gas inlet means;

cooled furnace gas outlet means;

process fluid inlet means; and heated process fluid outlet means;

said plurality of tubes in communication with said hot furnace gas inlet means to operably provide said tubes with said hot furnace gas and said cooled furnace gas outlet means;

the improvement comprising said process fluid inlet means having i. a first process fluid inlet aperture adjacent said first tube sheet and in communication with said shell space, and ii. a second process fluid inlet aperture adjacent said second tube sheet and in communication with said shell space.

Preferably, the heated process fluid outlet means comprises a fluid outlet essentially midway between said first and said second tube sheets and in communication with said shell space.

In a further preferred feature, the tubes of the tube bundle of the heat exchanger are aligned substantially vertical above the furnace. More preferably, the furnace is vertically aligned and has means to operably direct input air flow and input fuel flow vertically upward to operatively create a vertical flame substantially central around tile vertical axis of the furnace and wherein the tube bundle of the heat exchanger is vertically aligned and disposed above the furnace such that the central axis of tile bundle is co-axial with the aforesaid furnace vertical axis.

Thus, in a preferred aspect, the invention provides a preheating system having a combustion furnace mounted under a vertical heat exchanger with the furnace shell and exchange shell having a common vertical axis.

In operation, furnace gas upwardly passes through the tubes of the vertical exchanger. The inlet end of the exchanger is, most preferably, protected, where appropriate by a heat radiation shield, two ferrules and refractory materials from the high temperature of the furnace flame. From the upper vestibule of the exchanger, cooled furnace gas is either recycled to the furnace or is passed to an exhaust stack.

For improved thermal efficiency it is sometimes advantageous to add recycled stack gas, in whole or in part, instead of excess air to the system. The recycled gas may then be added as a quench downstream of the high intensity zone of the furnace and before entering the exchanger.

In a further modification according to a further aspect of the invention, cooled furnace gas from the heat exchanger is passed to a air/stack gas exchanger mounted co-axially above the main exchanger.

Thus, in the practice of the invention, cool process gas or other fluid entering the exchanger is split into two streams, one entering the shell space of the vertical exchanger below the top tube sheet and the second stream entering above the bottom tube sheet. The two streams flow away from their respective tube sheets towards, preferably, substantially, the mid-point of the exchanger where the heated process gas or fluid exits and flows to a subsequent process.

Thus, in a further aspect, the invention provides an improved process for raising the temperature of a process fluid by heat transfer with a hot furnace gas, comprising burning a fuel in a combustion furnace with an oxygen-containing gas to produce a hot gas; feeding said hot gas through the tubes of a heat exchanger; feeding said process fluid to the shell space of said heat exchanger for heat transfer with said hot gas to produce a heated fluid and a cooled gas; the improvement comprising feeding a first portion of said process fluid to said shell space adjacent a first end of said heat exchanger; feeding a second portion of said process fluid to said shell space adjacent a second end of said heat exchanger; and collecting said heated fluid as a combined heated said first and said second portions.

In a preferred aspect, the invention provides a process as hereinabove defined wherein said furnace is vertically aligned and has means to direct said oxygen-containing gas input and said fuel input vertically upward to create a vertical flame substantially central around tile vertical axis of the furnace and wherein the tube bundle of the heat exchanger is vertically aligned and disposed above said furnace such that the central axis of the bundle is co-axial with said furnace vertical axis; and comprising directing said oxygen-containing gas input and said fuel input to create said vertical flame and a vertical flow of said hot gas and directing said vertical flow of said hot gas to said first end of said heat exchanger.

The preheater system of the present invention has the ability to incorporate air heating without increasing the required plant area. In practise, the apparatus advantageously provides relatively cold process fluid or gas adjacent to the lower hottest tube sheet where tile hot furnace gas enters the exchanger. The resulting maximum temperature in the exchanger is shifted in consequence of the splitting of entry process fluid flow and the maximum metal temperature for any given inlet furnace gas temperature is relatively significantly lower. In consequence of the splitting of tile shell side process fluid flow into two streams, there is provided a desirable reduction in diameter and size of the exchanger. With a split stream as aforesaid, the shell space handles part of the fluid flow at any given elevation; which also results in a reduced exchanger diameter and economic cost.

The present invention provides for improved control of the metal temperatures in the exchanger. Shell side heat transfer coefficients in preheater exchangers are, typically, significantly higher than the associated tube side coefficient. This results in metal temperatures which are much closer to the shell fluid temperature than that of the hot tube fluid. This reduces the rate of high temperature corrosion and/or allows of higher furnace operating temperatures. Further, the invention provides cooling at both tube sheets and the maximum metal temperature is likely to be between the tube sheets and only affecting the tube metal.

Thus, the invention offers an effective furnace/heat exchanger design providing a more compact system, optimal furnace conditions and having a high heat flux in the exchanger.

BRIEF DESCRIPTION OF THE DRAWINGS

In order that the invention may be better understood preferred embodiments will now be described by way of example only with reference to the accompanying drawings wherein.

DETAILED DESCRIPTION OF PREFERRED EMBODIMENTS

Figure 1:
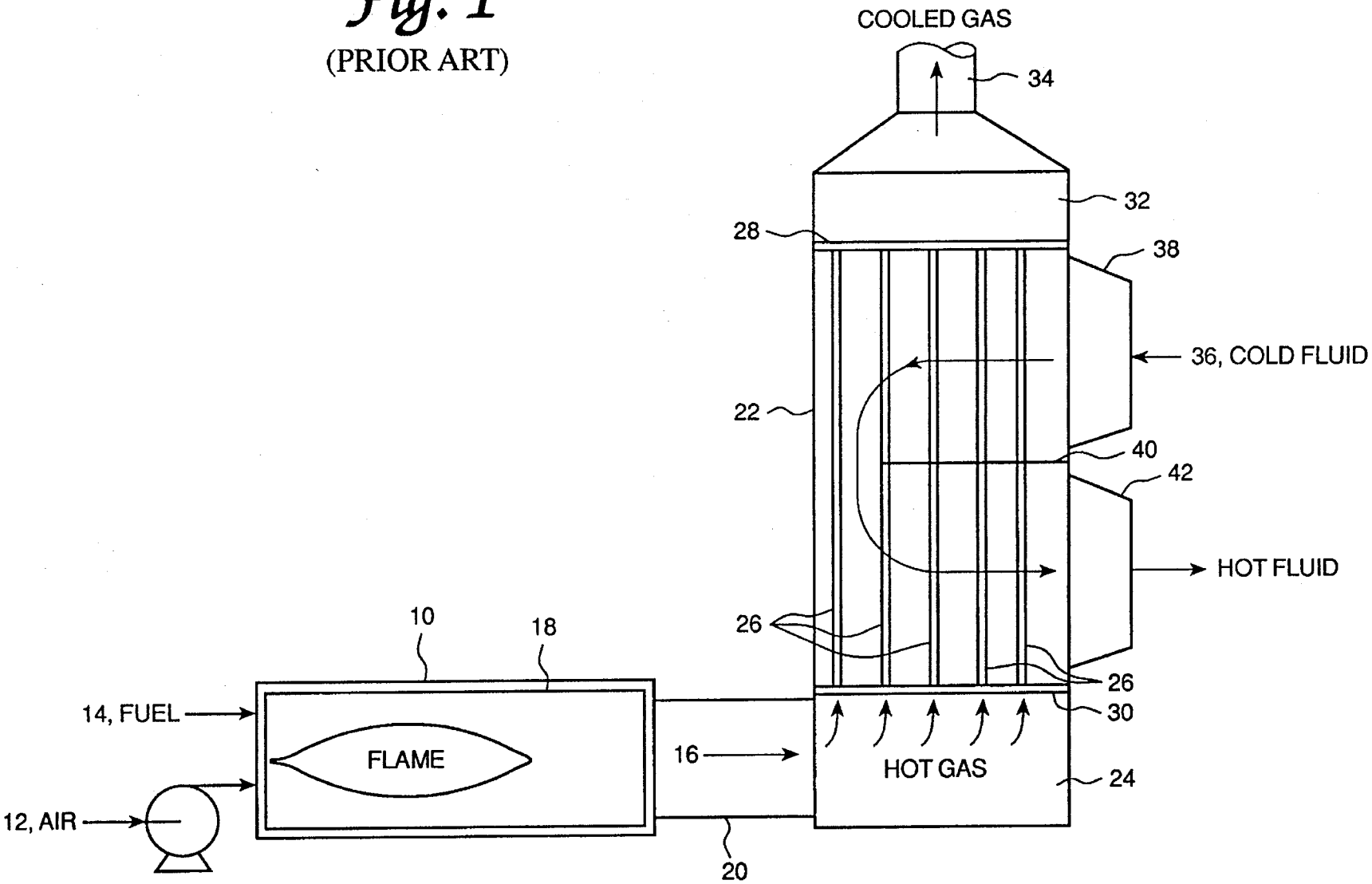
Fig. 1 (PRIOR ART)
FIG. 1 represents a diagrammatic vertical cross-sectional view of a prior art preheater.

With reference to FIG. 1, this shows a horizontal furnace 10 having fuel and air streams 12, 14, respectively entering furnace 10 at one end, thereof, and a hot furnace gas stream 16, exiting from furnace 10 at the other end thereof. Fuel 12 is burned in combustion furnace 10, typically, at a temperature of up to 650 degrees C. Furnace 10 has a brick lining 18 which must only be heated slowly and, thus, limits the availability of the preheater system for plant start-up purposes.

Hot furnace gas 16 passes through a nozzle 20 into preheat exchanger 22 through exchanger lower vestibule 24. Exchanger 22 has a plurality of tubes 26 which are retained within the shell by upper and lower tube sheets 28, 30, respectively. Hot gas 16 enters tubes 26 and exits through upper vestibule 32, as now cooled furnace gas out of exchanger furnace gas exit 34. Cold incoming process fluid-gas or air to be heated enters shell space as stream 36 through inlet 38 and flows, typically, around tubes and baffle 40 and out of process gas outlet 42.

In the above prior art embodiment, gas flows on the furnace side are large, typically, there is a large amount of excess air and unwanted production of smoke and nitrogen oxides. In addition, thermal efficiency is relatively low due to the inability to cool the furnace gases to very low temperatures without creating condensing conditions in exchanger 22.

Figure 2:
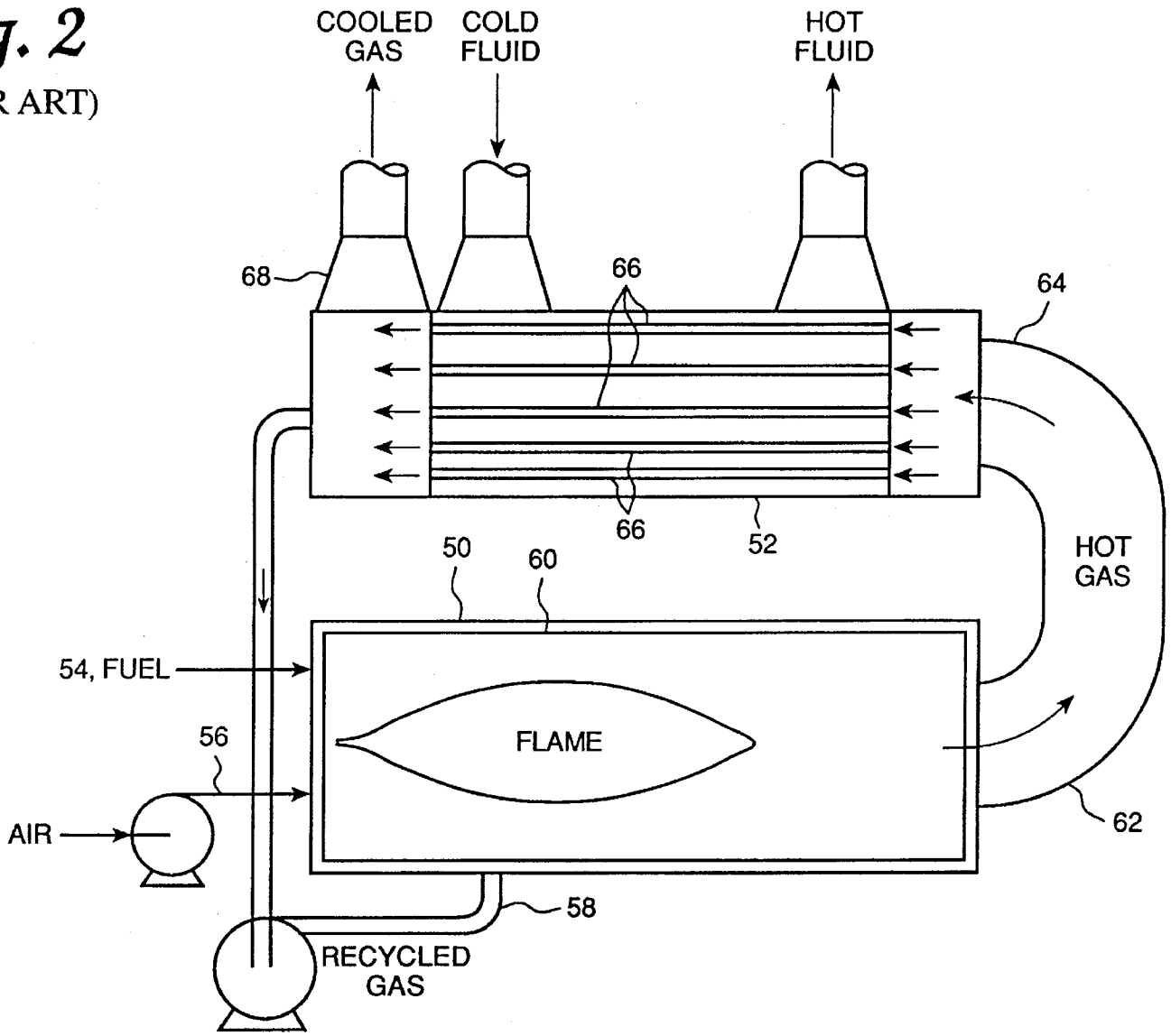
Fig. 2 (PRIOR ART)
FIG. 2 represents a diagrammatic vertical cross-sectional view of an alternative preheater system of the prior art.

FIG. 2 shows generally a horizontal combustion furnace 50 in association with a horizontally aligned heat exchanger 52 disposed upon furnace 50. Furnace 50 has fuel inlet 54 and gas inlets 56, 58, for fresh combustion air and a recycled stack gas stream, respectively. Furnace 50 has a brick lining 60 and hot furnace gas outlet nozzle 62 in the form of a 180 degree return bend which discharges horizontally into hot furnace gas inlet 64 of exchanger 52. Hot furnace gas flows horizontally through exchanger tubes 66 and out of outlet 68 as cooled furnace gas. From outlet 68, the cooled gas flows either to a stack or through recycle line 58. The embodiment of the prior art shown in FIG. 2 is more compact than that of the embodiment of FIG. 1 and, typically, has stainless steel tubing.

Figure 3:
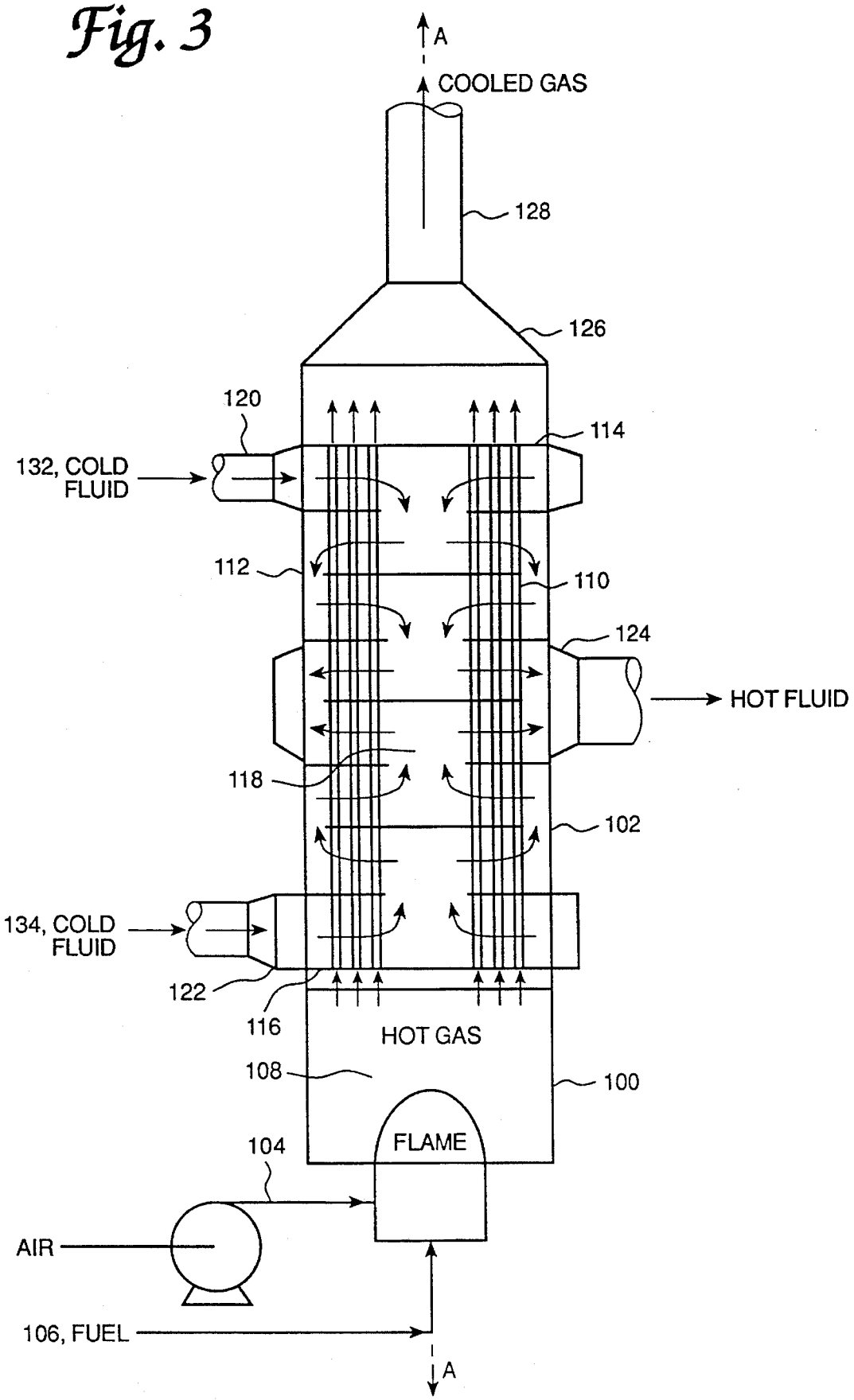
FIG. 3 represents a diagrammatic vertical cross-sectional view of a preheater system according to the invention.

Reference is now made to FIG. 3, which represents a preferred preheater of the invention having a vertical furnace 100 supporting a vertical heat exchanger 102.

Furnace 100 has an air inlet 104 and a fuel inlet 106. Furnace 100 is formed of carbon steel having an inner lining of insulating brick and exchanger 102 of stainless steel and are so arranged that right vertical cylindrical furnace chamber 108 and the central axis of tube bundle 110 of exchanger 102 are coaxial and have a common central vertical axis A—A.

Exchanger 102 has a shell 112, an upper tube sheet 114 and lower tube sheet 116 defining a shell space 118 therebetween. Heat exchanger 102 has an upper process fluid inlet 120 adjacent upper tube sheet 114, a lower process fluid inlet 122 adjacent lower tube sheet 116 and a combined heated process fluid outlet 124, midway between upper and lower tube sheets 114, 116 respectively in communication with shell space 118. Exchanger 102 has a cooled furnace gas upper vestibule 126 leading to outlet 128.

In operation, incoming air and fuel are burned in furnace chamber 108 to provide a furnace gas which flows up into tubes 108 to outlet vestibule 126 and outlet 128. An incoming process gas stream splits into two essentially equal side streams 132, 134 which enter shell space 118 through inlets 120 and 122, respectively. The split streams flow up and down, respectively, through exchanger 102 around tube bundle 110 and baffles 119 as shown, generally, by the arrows. The heated process gas combines at intermediate points in exchanger 102 and exit through outlet 124.

With reference to FIGS. 1, 2, and 3, it will be seen that the lower tube sheet 116 of FIG. 3 is exposed to the hottest gas only on the furnace gas side. On the shell side, tube sheet 116 is exposed to the coldest gas. This is to be contrasted to the lowest or first tube sheet of FIG. 1 and FIG. 2 where the inner surface of the tube sheets is exposed to the hot process gas on the shell side. Thus, the FIG. 3 arrangement according to the invention provides for a drastic lowering of the tube sheet temperature or, in the alternative, an ability for use of much higher furnace temperatures without exposing tube sheet 116 to excessive temperatures. It is suggested that the maximum tube metal temperature will occur about the mid-point of exchanger 102 where combined hot process fluid is present. But here, the only significant metal exposed to the relatively high temperature will be tubes 110 which bear only a light mechanical load. The combination of the furnace and heat exchanger on a common vertical axis provides a discharge point for cooled furnace gases higher in the air and offers a decrease in the height of a stack needed to optionally, discharge the combustion products to atmosphere.

Figure 4:
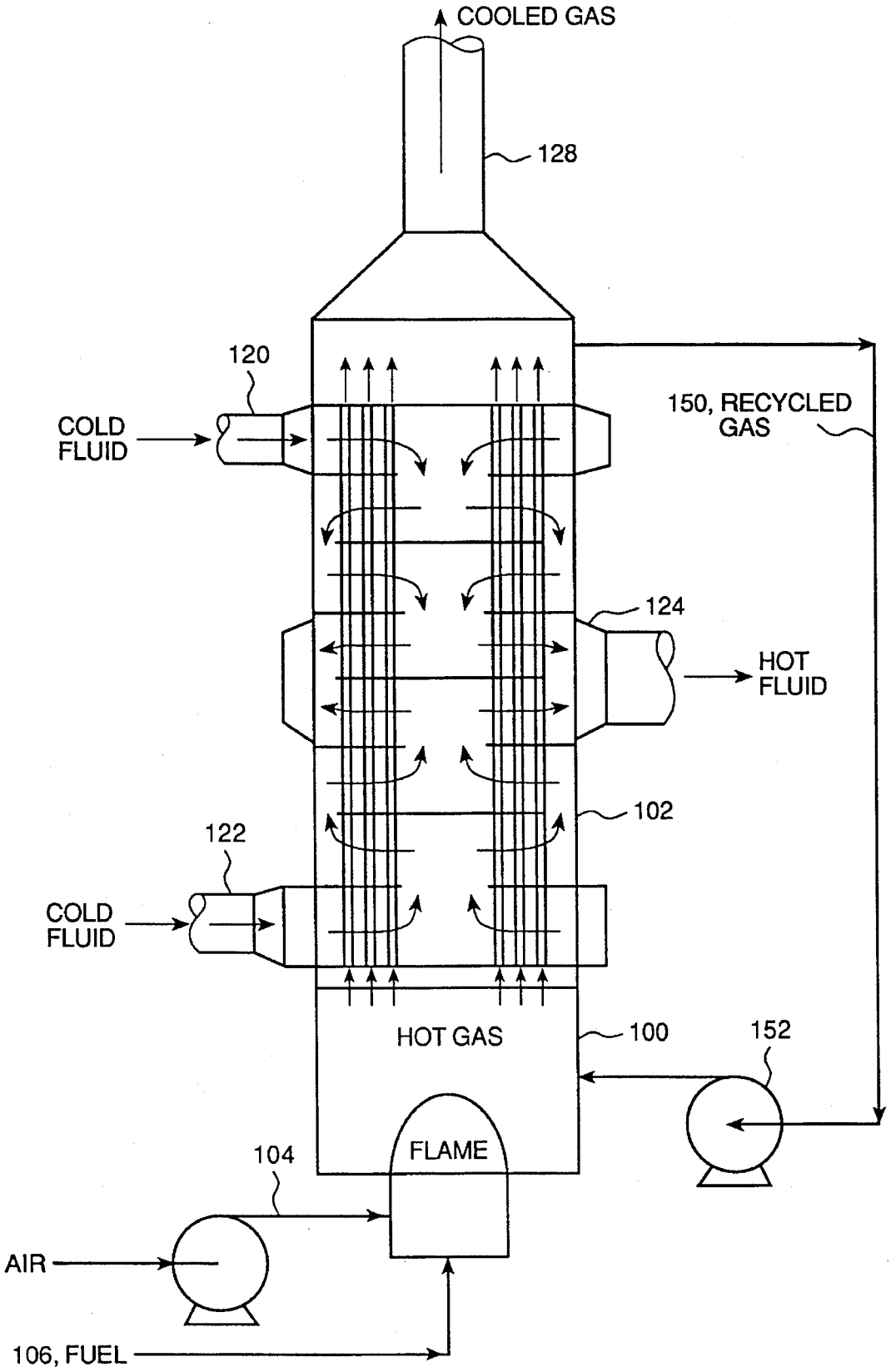
FIG. 4 represents a diagrammatic vertical cross-sectional view of a preheater system incorporating a stack gas recycle, according to the invention.

FIG. 4 shows a variation of the apparatus of the present invention which incorporates a stack gas recycle line 150 associated with a separate fan or blower 152.

Figure 5:
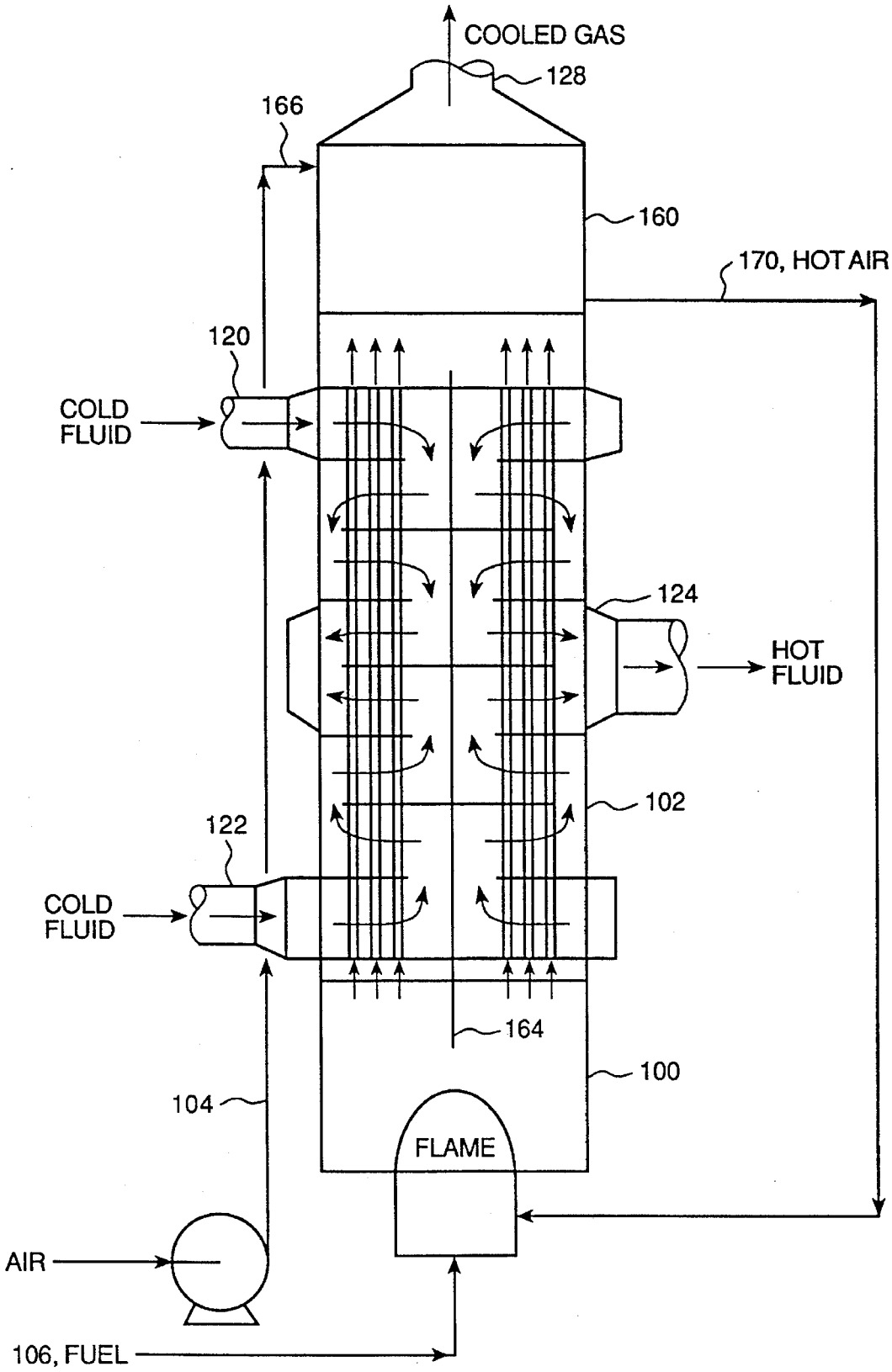
FIG. 5 represents a diagrammatic vertical cross-sectional view of a preheater system incorporating air preheating, according to the invention.

FIG. 5 shows an air heater 160 supported by exchanger 102 having a central axis co-axial with the vertical axis of the plurality of tubes and furnace 164. Heater 160 receives an air stream from conduit 166 to the shell side of air heater 160 and in counter-current flow to upward stack gas flow and then to furnace 100 via conduit 170.

Figure 6:
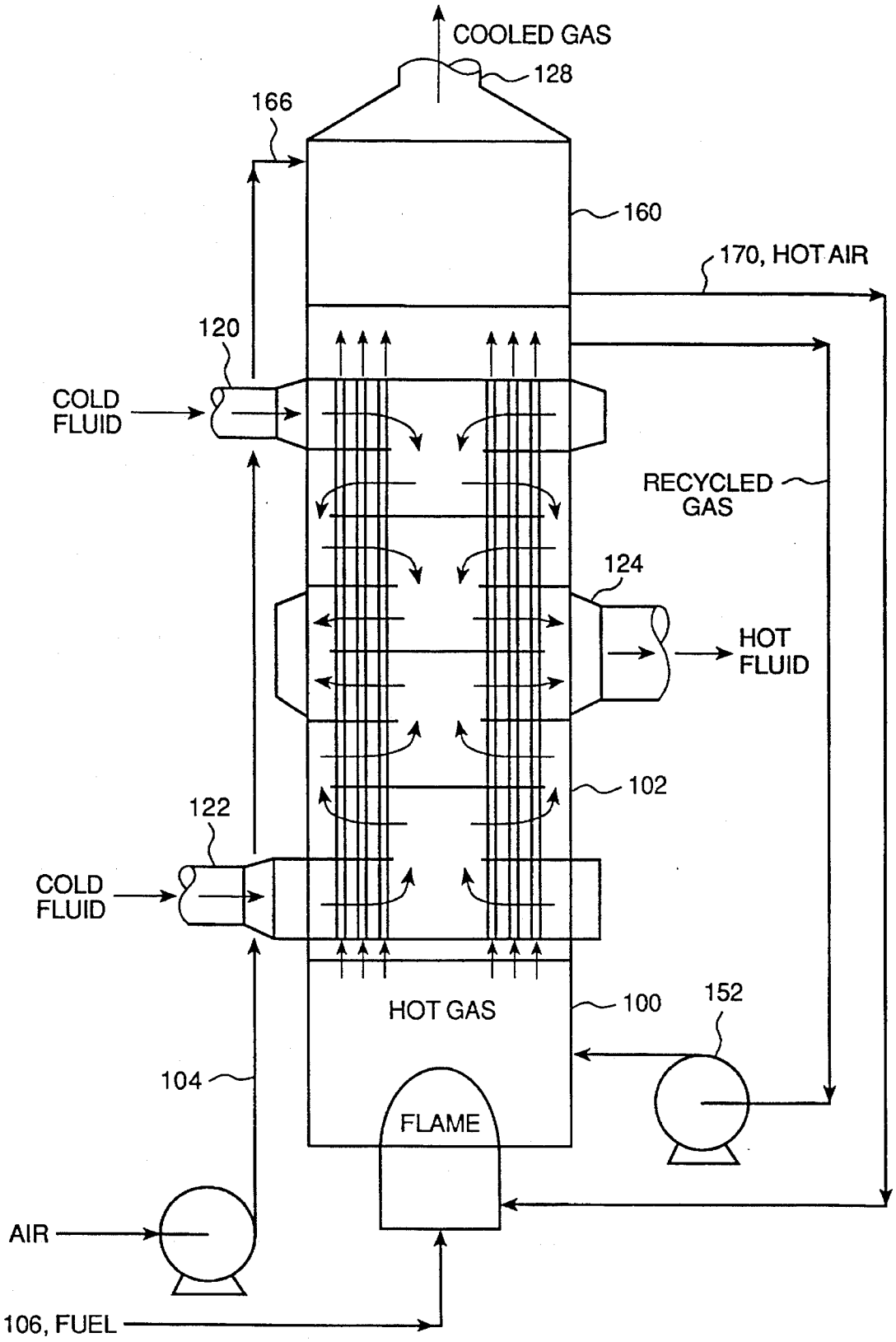
FIG. 6 represents a diagrammatic vertical cross-sectional view of a preheater system incorporating air preheating and stack gas recycle, according to the invention; and wherein the same numerals denote like parts throughout the figures and arrows denote gas or fluid flows.

FIG. 6 incorporates both stack gas recycle and air preheating in the preheater system. Here the three process units are arranged axially in a vertical line and the flow of air 104 through the air heater 160 preheats the air before it enters the furnace 100 where it is used for primary combustion. The recycled stack gas is shown as taken from the exit of the exchanger 102 and is recirculated through fan or blower 152 to the furnace 100. The quantity of recycle will depend on the level of excess oxygen that must be present in the stack gas to ensure that combustion is complete and that nitrogen oxide formation is minimized. This arrangement offers very high efficiencies as the quantity of stack gas is set primarily by the amount of fuel burned and the air heating has dropped the stack gas temperature to minimum values.

The subject of preheater system efficiencies is now considered using, as a base, combustion of natural gas which is a preferred fuel. In simple terms the air in the furnace is heated up to a given temperature and cooled down in the process heater. For the simplest case shown in FIG. 1 the air is heated by combustion to 450 degrees C. from 25 degrees and the combustion gas is cooled down from 600 degrees C. to 320 degrees, recovering 280 degrees of heat from the furnace gas out of 575 degrees, corresponding to a thermal efficiency slightly below 50%.

For the next case shown in FIG. 3 the furnace temperature has been raised to 1000 degrees C. and the gas is cooled in the preheater to 375 degrees C. The heat input to the furnace gas is 1000 less 25 or 975 degrees. The gas is cooled in the exchanger from 1000 to 375 degrees or 625 degrees so the efficiency is then 625 out of 975 degrees or around 64%.

Where stack gas is recycled around the system, as is the case in FIGS. 2 and 4, the efficiency is raised by the heat recovered by recycle. Assuming for example that the recycle stream has approximately the same heat capacity as the incoming air, the mixed air plus gas fed to the furnace will be at a mix temperature of 375 plus 25 or 200 degrees and the heat input to the furnace gas is 1000 less 200 or 800 degrees while the heat transferred is 1000 less 375 or 625 degrees. The efficiency is now 625/800 or 78%.

In the next case, FIG. 5, the air entering the furnace has been preheated by the stack gas and the overall effect is to decrease the stack gas temperature. Assuming for example a reduction of stack gas temperature of 125 degrees, the effect is to increase the efficiency from the Case 3 value of 625/975 to 625/850 or from 64% to 74%.

Combining the two improvement features as in FIG. 6 with the same assumptions will further increase the efficiency by raising the inlet gas mixture temperature to the furnace to 285 degrees while decreasing the temperature of stack gas to 260 degrees giving an efficiency of 720/785 or 92%.

These numbers while only approximate illustrate the effects of the changes on efficiency.

Consider next the advantage of the split flow on top of the other features. Consider the same metal temperature of 650 degrees C. as a design point. For the conventional design this point is at the hot tube sheet. With 485 degree C. process gas and 1000 degree C. furnace gas there is a 515 degree (C.) difference between the two streams and the metal will be slightly closer to the colder shell side stream and probably above the 650 (C.) limit. With split flow, the hot tube sheet will be between 90 degrees (C.) (the cold shell side stream) and the 1000 (C.) furnace gas and much colder than in the previous case. Even at 1200 degrees (C.), the tube sheet will still be significantly colder than the previous case and the 650 (C.) figure previously cited. The hottest point in the exchanger will be at the point where the two streams have been heated to 485 (C.) and the tube side gas is half cooled from 1200 to 375 degrees, i.e. at 790 degrees (C.). Here the difference between the two fluids will be 300 (C.) and the tubes are likely to be at 485 plus 90 or 590 (C.) degrees, below the 650 (C.) limit previously suggested. Clearly the furnace temperature could be increased even higher without violating this constraint.

It is also obvious that increasing furnace temperature with a fixed stack temperature results in increasing efficiency and in reducing the stack gas that has to be recycled.

There are many variations on this concept which will be apparent to the practitioner skilled in tile heat transfer art including points of fluid take-off and fluid injection and methods for combining the process vessels. Such include use of an intermediate tube sheet in FIGS. 5 and 6 between the air heating and process heating portions of the heat exchanger train, tile recycle of stack gas from between the two exchangers, combination of the recycled stack gas with the air in the air heater and the use of a single fan for simplicity, and use of uneven splits between the streams of process gas to the process heat exchanger. The take-off point of the heated gas can also be shifted along the axis of this exchanger for a variety of reasons and it would also be possible as part of the consideration to set tip tile process exchanger with two sections, a top countercurrent zone to improve thermal efficiency and a second parallel flow lower zone to lower metal temperatures in tile region where the hot furnace gas is in the tubes. This two zone approach would however require a much larger shell as the shell flow would be equal to tile total process gas flow as opposed to approximately half as in the preferred embodiment.

It is also possible by varying the baffle spacing to improve the shell side heat transfer coefficient in the region where the tubes are hottest and thus lower even further the metal temperature at the hottest points in the exchanger.

Although this disclosure has described and illustrated certain preferred embodiments of the invention, it is to be understood that the invention is not restricted to those particular embodiments. Rather, the invention includes all embodiments which are functional or mechanical equivalence of the specific embodiments and features that have been described and illustrated.

I claim:

1. An improved process fluid preheater system for raising the temperature of a process fluid by heat transfer with a hot furnace gas, said system having a combustion furnace in communication with a shell and tube heat exchanger, wherein said furnace operably produces said hot furnace gas and comprises air inlet means, fossil fuel inlet means, a combustion chamber, and hot furnace gas exit means; and said heat exchanger comprises an exchanger shell, a first end tube sheet and a second end tube sheet, which said shell and said tube sheets define a shell space;

a tube bundle comprising a plurality of longitudinal tubes retained by said first and second end tube sheets within said shell space and comprise heat exchange means;

hot furnace gas inlet means;

cooled furnace gas outlet means;

process fluid inlet means; and heated process fluid outlet means;

said plurality of tubes in communication with said hot furnace gas inlet means to operably provide said tubes with said hot furnace gas and said cooled furnace gas outlet means;

the improvement comprising said process fluid inlet means having i. a first process fluid inlet aperture adjacent said first tube sheet and in communication with said shell space, and ii. a second process fluid inlet aperture adjacent said second tube sheet and in communication with said shell space.

2. A preheater system as claimed in claim 1 wherein said heated process fluid outlet means comprises a fluid outlet aperture essentially midway between said first and said second tube sheets and in communication with said shell space.

3. A preheater system as claimed in claim 1 wherein said tubes of said heat exchanger are aligned substantially vertically above said furnace.

4. A system as claimed in claim 1 wherein said process fluid is gaseous.

5. A system as claimed in claim 4 wherein said gaseous process fluid is selected from the group consisting of air and sulfur dioxide.

6. A system as claimed in claim 1 further comprising a distinct secondary heat exchanger having a plurality of vertically aligned secondary tubes coaxially disposed above said heat exchanger.

7. A system as claimed in claim 1 wherein said furnace is vertically aligned and has means to operably direct input air flow and input fuel flow vertically upward to operatively create a vertical flame substantially central around the vertical axis of the furnace and wherein the tube bundle of the heat exchanger is vertically aligned and disposed above the furnace such that the central axis of the bundle is co-axial with the aforesaid furnace vertical axis.

8. An improved process for raising tile temperature of a process fluid by heat transfer with a hot furnace gas, comprising burning a fuel in a combustion furnace with an oxygen-containing gas to produce a hot gas; feeding said hot gas through the tubes of a heat exchanger; feeding said process fluid to the shell space of said heat exchanger for heat transfer with said hot gas to produce a heated fluid and a cooled gas; tile improvement comprising feeding a first portion of said process fluid to said shell space adjacent a first end of said heat exchanger; feeding a second portion of said process fluid to said shell space adjacent a second end of said heat exchanger; and collecting said heated fluid as a combined heated said first and said second portions.

9. A process as claimed in claim 8 wherein said combined heated fluid is collected from said shell space at an outlet aperture substantially midway of said heat exchanger.

10. A process as claimed in claim 8 wherein said fluid is gaseous.

11. A process as claimed in claim 10 wherein said gaseous fluid is selected from air or a sulfur dioxide-containing gas.

12. A process as claimed in claim 8 wherein said first end of said heat exchanger is at a higher temperature than said second end of said heat exchanger.

13. A process as claimed in claim 8 wherein said furnace is vertically aligned and has means to direct said oxygen-containing gas input and said fuel input vertically upward to create a vertical flame substantially central around the vertical axis of the furnace and wherein the tube bundle of the heat exchanger is vertically aligned and disposed above said furnace such that the central axis of the bundle is co-axial with said furnace vertical axis; and comprising directing said oxygen-containing gas input and said fuel input to create said vertical flame and a vertical flow of said hot gas and directing said vertical flow of said hot gas to said first end of said heat exchanger.

* * * * *